US010003903B2

(12) United States Patent
Dougherty et al.

(10) Patent No.: US 10,003,903 B2
(45) Date of Patent: Jun. 19, 2018

(54) METHODS FOR DETERMINING RELATIVE LOCATIONS OF WIRELESS LOUDSPEAKERS

(71) Applicant: Avago Technologies General IP (Singapore) Pte. Ltd., Singapore (SG)

(72) Inventors: James Dougherty, Morgan Hill, CA (US); Juin-Hwey Chen, Irvine, CA (US)

(73) Assignee: Avago Technologies General IP (Singapore) Pte. Ltd., Singapore (SG)

( * ) Notice: Subject to any disclaimer, the term of this patent is extended or adjusted under 35 U.S.C. 154(b) by 0 days. days.

(21) Appl. No.: 15/242,218

(22) Filed: Aug. 19, 2016

(65) Prior Publication Data

US 2017/0055097 A1 Feb. 23, 2017

Related U.S. Application Data

(60) Provisional application No. 62/208,387, filed on Aug. 21, 2015, provisional application No. 62/356,832, filed on Jun. 30, 2016.

(51) Int. Cl.
*H04S 7/00* (2006.01)
*H04R 5/02* (2006.01)

(52) U.S. Cl.
CPC ..... *H04S 7/301* (2013.01); *H04R 5/02* (2013.01); *H04S 7/302* (2013.01); *H04S 7/308* (2013.01); *H04R 2205/024* (2013.01); *H04R 2420/07* (2013.01)

(58) Field of Classification Search
CPC ..... H04S 7/301; H04S 7/302; H04S 7/308; H04R 2205/024; H04R 2420/07
See application file for complete search history.

(56) References Cited

U.S. PATENT DOCUMENTS

2011/0091055 A1* 4/2011 LeBlanc ..... H04S 7/301 381/303
2014/0362995 A1* 12/2014 Backman ..... H04S 7/301 381/17
2015/0381296 A1* 12/2015 Jenq ..... H04S 1/007 381/2

* cited by examiner

*Primary Examiner* — Mark Fischer
(74) *Attorney, Agent, or Firm* — Sterne, Kessler, Goldstein & Fox P.L.L.C.

(57) ABSTRACT

Methods, systems, and apparatuses are described for determining relative locations of wireless loudspeakers and performing channel mapping thereof. An audio processing component utilizes sounds produced by wireless loudspeakers during setup/installation procedures, which are received by a microphone at locations in an acoustic space, to determine an amount of time between when the audio signal is initially transmitted and when the microphone signal is received. The audio processing component also utilizes wireless timing signals provided by a wireless transceiver, at locations in the acoustic space, to wireless loudspeakers and then back to the wireless transceiver to determine an amount of time between transmission and reception by the wireless transceiver. The timing delays are used to determine the locations of the wireless loudspeakers in the acoustic space. Based on the determined locations, the audio processing component generates indications of correct or incorrect wireless loudspeaker placements, and performs audio channel mapping.

20 Claims, 5 Drawing Sheets

METHODS FOR DETERMINING RELATIVE LOCATIONS OF WIRELESS LOUDSPEAKERS

CROSS-REFERENCE TO RELATED APPLICATIONS

The instant application claims priority to U.S. Provisional Patent Application No. 62/356,832, entitled "Methods for Determining Relative Locations of Wireless Loudspeakers," filed on Jun. 30, 2016, and claims priority to U.S. Provisional Patent Application No. 62/208,387, entitled "Methods for Determining Relative Locations of Wireless Loudspeakers," filed on Aug. 21, 2015, the entirety of each of which is incorporated by reference herein.

BACKGROUND

I. Technical Field

Embodiments described herein relate to systems with wireless loudspeakers.

II. Background Art

Wireless loudspeaker systems are becoming popular in recent years. In conventional wired loudspeaker systems, loudspeakers for specific audio channels such as Left (L), Right (R), Center (C), Surround Left (SL), Surround Right (SR), Low-Frequency Effects (LFE), etc. are physically connected by wires to the corresponding output ports of the power amplifier. For wireless loudspeaker systems, there are no wires between loudspeakers and a central unit, so each loudspeaker needs to be properly assigned or mapped to a specific output audio channel depending on the location of that loudspeaker relative to the listener. This is called "channel mapping."

BRIEF SUMMARY

Methods, systems, and apparatuses are described for determining relative locations of loudspeakers, substantially as shown in and/or described herein in connection with at least one of the figures, as set forth more completely in the claims.

BRIEF DESCRIPTION OF THE DRAWINGS/FIGURES

The accompanying drawings, which are incorporated herein and form a part of the specification, illustrate embodiments and, together with the description, further serve to explain the principles of the embodiments and to enable a person skilled in the pertinent art to make and use the embodiments.

Embodiments will now be described with reference to the accompanying drawings. In the drawings, like reference numbers indicate identical or functionally similar elements. Additionally, the left-most digit(s) of a reference number identifies the drawing in which the reference number first appears.

DETAILED DESCRIPTION

I. Introduction

Figure 1:
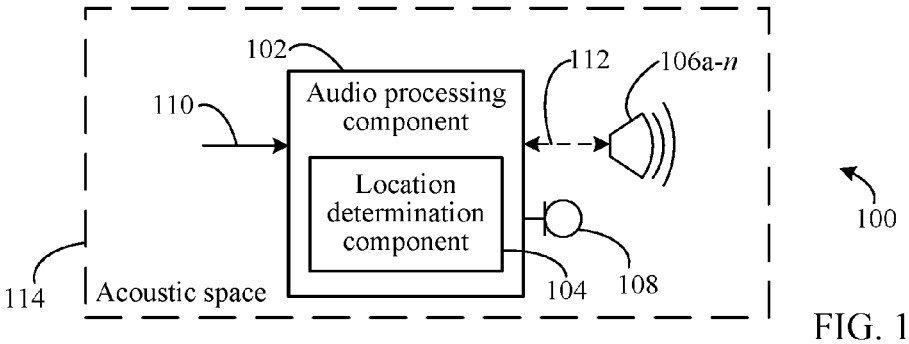
FIG. 1 shows a block diagram of a system with audio processing in an acoustic space, according to an example embodiment.

The present specification discloses numerous example embodiments. The scope of the present patent application is not limited to the disclosed embodiments, but also encompasses combinations of the disclosed embodiments, as well as modifications to the disclosed embodiments.

References in the specification to "one embodiment," "an embodiment," "an example embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described herein.

In the discussion, unless otherwise stated, adjectives such as "substantially," "approximately," and "about" modifying a condition or relationship characteristic of a feature or features of an embodiment of the disclosure, are understood to mean that the condition or characteristic is defined to be within tolerances that are acceptable for operation of the embodiment for an application for which it is intended.

Furthermore, it should be understood that spatial descriptions (e.g., "above," "below," "up," "left," "right," "down," "top," "bottom," "vertical," "horizontal," "center," "front," "rear," etc.) used herein are for purposes of illustration only, and that practical implementations of the structures described herein can be spatially arranged in any orientation or manner.

Still further, it should be noted that the drawings/figures are not drawn to scale unless otherwise noted herein.

Numerous exemplary embodiments are now described. Any section/subsection headings provided herein are not intended to be limiting. Embodiments are described throughout this document, and any type of embodiment may be included under any section/subsection. Furthermore, it is contemplated that the disclosed embodiments may be combined with each other in any manner. That is, the embodiments described herein are not mutually exclusive of each other and may be practiced and/or implemented alone, or in any combination.

II. Example Embodiments

The example techniques and embodiments described herein may be adapted to various types of systems and devices, for example but without limitation, systems or devices including audio processing devices/components, loudspeakers (including wireless loudspeakers), home entertainment systems, televisions, stand-alone loudspeaker units, personal computers and laptops, communication devices (e.g., cellular and smart phones), wireless device accessories, headsets, personal digital assistants (PDAs), portable music players, handheld gaming devices and gaming consoles, and/or the like, that include loudspeakers, such as but not limited to wireless loudspeakers. That is, while the embodiments herein may be described with respect to wireless loudspeakers as conceptual and/or illustrative examples for descriptive consistency, other types of loudspeakers are also contemplated for implementing the disclosed techniques. An audio processing device or component may be any device or component that processes and/or provides audio signals as outputs, e.g., to be played back by loudspeakers, stored for later playback, etc., according to embodiments. It is contemplated herein that in various embodiments and with respect to the illustrated figures of this disclosure, one or more components described and/or shown may not be included and that additional components may be included.

The techniques described herein provide for location determination of loudspeakers, e.g., wireless loudspeakers, etc., as well as channel mapping and location indications for proper/improper placement of loudspeakers in an acoustic space based on the location determination. The described techniques and embodiments provide for efficient, robust loudspeaker location determinations using wireless timing information (e.g., IEEE 1588 and IEEE 802.1AS (Clause 12—802.11v) point-to-point protocol standards), calculations of wireless audio signal timing, and/or a combination of both of these.

For example, in an embodiment, an audio processing system/device may include a wireless transceiver (e.g., a Wi-Fi® transceiver) configured to provide/transmit wireless audio transmission signals to wireless loudspeakers and receive microphone signals based on sounds corresponding thereto, and to provide/transmit and receive wireless timing transmission signals with timing information to and from wireless loudspeakers. Wireless loudspeakers may also include wireless transceivers configured to provide/transmit and receive additional wireless timing transmission signals with additional timing information to and from other wireless loudspeakers. The timing and additional timing information may be determined based on a transmission of a wireless transceiver to all of the receivers (e.g., loudspeakers) for wireless audio transmission signals and for wireless timing signals, and/or from each loudspeaker to one or more other loudspeakers for wireless timing signals, from which telemetry information (e.g. angle, distance) may be computed.

According to the described embodiments, a location determination unit may include a digital timing engine which inserts/extracts high precision timestamps into/from wirelessly transmitted/received packets. This timestamping may be performed as defined by IEEE 1588 (clock mechanics) and IEEE 802.1AS (clock distribution), however, it is contemplated herein that in embodiments, alternate and/or equivalent packet bit definitions and semantics may be implemented.

Based on the timing information and/or information determined from the microphone signals, wireless loudspeaker locations can be automatically determined in 2-D and 3-D acoustic spaces, including relative heights of wireless loudspeakers, as described herein. Channel mapping for the wireless loudspeakers is automatically performed based on the location information, according to embodiments. Additionally, automatic indications of correct or incorrect placement of wireless loudspeakers in an acoustic space are provided based on the location information, in embodiments. These techniques allow for fewer errors and increased efficiency in the setup/calibration and installation of wireless loudspeakers and associated systems. The described techniques and embodiments are extensible for application to any listening locations of a listener in an acoustic space, as well as any wireless loudspeaker configurations, e.g. 2.0, 2.1, 5.1, 7.1, beyond 7.1, etc. That is, the described techniques and embodiments provide for proper loudspeaker placement and setup relative to a listening position in terms of the horizontal angles and the heights of loudspeakers, and simplifies the setup of systems with wireless loudspeakers which increase in complexity with the number of loudspeakers included, e.g., 7.1 and beyond 7.1, and varying loudspeaker placements, such as, but not limited to, channel mapping of more advanced surround sound loudspeaker systems that include "height speakers" installed in the ceiling, such as the Dolby® Atmos™.

For instance, if a user has placed wireless loudspeakers (e.g., the surround-sound loudspeakers, stereo loudspeakers, etc.) too high, too low, or at non-ideal horizontal angles relative to a listening position, the described techniques and embodiment are configured to provide indications/suggestions to the user to reposition the wireless loudspeakers in an ideal or improved configuration (e.g., by changing the placement of one or more of the wireless loudspeakers) for a better listening experience. Additionally, the described techniques and embodiment are configured to automatically map channels for the loudspeakers dynamically based on user location relative to a "virtual" system center, e.g., by also using Location Based Services (LBS).

A system or device may include without limitation devices/components for providing/transmitting and receiving wireless audio transmission signals, components for providing/transmitting and receiving wireless timing transmission signals, e.g., with timing information, at least one microphone, components for loudspeaker location determination, components for loudspeaker channel mapping, and/or components for providing loudspeaker location indications, according to embodiments. Systems and devices described herein, along with their respective components, may be configured in various ways to perform their functions.

FIG. 1 shows a block diagram of a system 100 with audio processing, according to an embodiment. System 100 includes an audio processing component 102, at least one microphone 108, and one or more loudspeakers 106*a-n*, in an acoustic space 114. Audio processing component 102 includes a location determination component 104. Audio processing component 102 is configured to receive audio input signals/frames via an input 110 from devices or services (not shown) that provide audio content to be played back by loudspeakers (e.g., from AM/FM receivers, compact disc players, digital versatile disc players, televisions, online streaming services for audio/multimedia content, computers and tablets, portable music players, smart phones, and/or the like). Received audio inputs are processed by audio processing component 102 and provided/transmitted to loudspeakers 106*a-n* in audio transmission signals to generate sounds via a connection 112 that may be wired, wireless (e.g., via a wireless transceiver, described below), or a combination thereof. That is, according to embodiments, loudspeakers 106*a-n* may be wired or wireless loudspeakers. Microphone(s) 108 may be wired or wireless, in embodiments, and is configured to receive sounds generated by loudspeakers 106*a-n* and provide corresponding microphone signals to audio processing component 102.

Location determination component 104 is configured to determine the locations of loudspeakers 106*a-n* as described herein, for example, based on audio transmission signal timing. In embodiments, the locations may be locations relative to audio processing component 102, or a system thereof, or relative a listening area(s) of a user. The locations may also be determined, in whole or in part, based on other wireless timing information as described herein, such as, but not limited to, wireless timing information obtained from wireless signals exchanged between components of system 100 according to IEEE 1588 and IEEE 802.1AS point-to-point protocol standards, further details of which are provided below. It is also contemplated that location determination component 104 may reside outside of, or be a separate component from, audio processing component 102, according to embodiments.

According to embodiments, and as described in further detail below, audio processing component 102 is also configured to perform loudspeaker channel mapping and/or to provide loudspeaker location indications, for loudspeakers 106*a-n* based on location information from location determination component 104.

Acoustic space 114 may be a room in a home, a theater, an office, or another 3-D space in which system 100 produces audio sounds, in embodiments. Acoustic space 114 may include various objects such as furniture, curtains and/or window treatments, flooring such as carpet, and/or the like, that interfere with or alter acoustic quality or performance of system 100. Such interference or alterations may be mitigated or corrected using active room correction, e.g., performed by system 100, according to embodiments. It is contemplated herein that location determination component 104 may determine timing information as described herein from microphone signals based on sounds produced during the performance of active room correction.

The described techniques and embodiments improve the setup and performance of loudspeakers by accurately determining loudspeaker locations in an acoustic space.

For instance, methods, systems, devices, and apparatuses are provided for loudspeaker location determination, channel mapping, and location indications. A system in accordance with an example aspect is described. The system includes a plurality of wireless loudspeakers for an acoustic space, and an audio processing component. Each of the plurality of wireless loudspeakers is configured to receive wireless audio transmission signals and produce a corresponding sound, receive wireless timing transmission signals, and transmit responsive wireless timing transmission signals in response to receiving the wireless timing transmission signals. The audio processing component includes a wireless transceiver, at least one microphone, a location determination component, and at least one of a channel mapping component or a location indication component. The wireless transceiver is configured to provide the wireless audio transmission signals, provide wireless timing transmission signals to each of the plurality of wireless loudspeakers, and receive the responsive wireless timing transmission signal that includes timing information from each of the plurality of wireless loudspeakers. The at least one microphone is configured to receive the corresponding sound of each of the plurality of wireless loudspeakers at a plurality of microphone positions in the acoustic space and generate a corresponding microphone signal for determining a corresponding wireless loudspeaker location. The location determination component is configured to determine a location in the acoustic space of one or more of the plurality of wireless loudspeakers based on one or more of the corresponding microphone signal at the plurality of microphone positions and the timing information. The channel mapping component is configured to determine a channel mapping of the plurality of wireless loudspeakers based on the location. The location indication component is configured to generate and provide a location indication to a user, the location indication being indicative of whether a loudspeaker of the plurality of wireless loudspeakers is properly located based on the location.

A system in accordance with another example aspect is also described. The system includes a wireless transceiver, a location determination component, and at least one of a channel mapping component or a location indication component. The wireless transceiver is configured to provide wireless timing transmission signals to each of a plurality of wireless loudspeakers in an acoustic space, and receive a responsive wireless timing transmission signal from each of the plurality of wireless loudspeakers. The location determination component is configured to determine a location in the acoustic space of one or more of the plurality of wireless loudspeakers based on the timing information. The channel mapping component is configured to determine a channel mapping of the plurality of wireless loudspeakers based on the location. The location indication component is configured to generate and provide a location indication to a user, the location indication being indicative of whether a loudspeaker of the plurality of wireless loudspeakers is properly located based on the location.

A system in accordance with yet another example aspect is also described. The system includes a plurality of wireless loudspeakers in an acoustic space, each configured to receive wireless audio transmissions and produce corresponding sounds, and an audio processing component. The audio processing component includes a wireless transceiver, at least one microphone, a location determination component, and at least one of a channel mapping component or a location indication component. The wireless transceiver is configured to provide the wireless audio transmissions. The at least one microphone is configured to receive the corresponding sounds of each of the plurality of wireless loudspeakers at a plurality of microphone positions in the acoustic space, and generate corresponding microphone signals for determining a corresponding wireless loudspeaker location. The location determination component is configured to determine a location in the acoustic space of one or more of the plurality of wireless loudspeakers based on one or more of the corresponding microphone signals at the plurality of microphone positions. The channel mapping component is configured to determine a channel mapping of the plurality of wireless loudspeakers based on the location. The location indication component is configured to generate and provide a location indication to a user, the location indication being indicative of whether a loudspeaker of the plurality of wireless loudspeakers is properly located based on the location.

Various example embodiments are described in the following subsections. In particular, example audio signal location embodiments are described. This description is followed by example IEEE 1588 and IEEE 802.1AS embodiments. Next, example combination embodiments are described, followed by further example embodiments and advantages. Subsequently an example processing device implementation is described. Finally, some concluding remarks are provided. It is noted that the division of the following description generally into subsections is provided for ease of illustration, and it is to be understood that any type of embodiment may be described in any subsection.

III. Example Loudspeaker Location Embodiments

As noted above, systems and devices for loudspeaker location determination, along with their components, may be configured in various ways to perform their functions.

Figure 2:
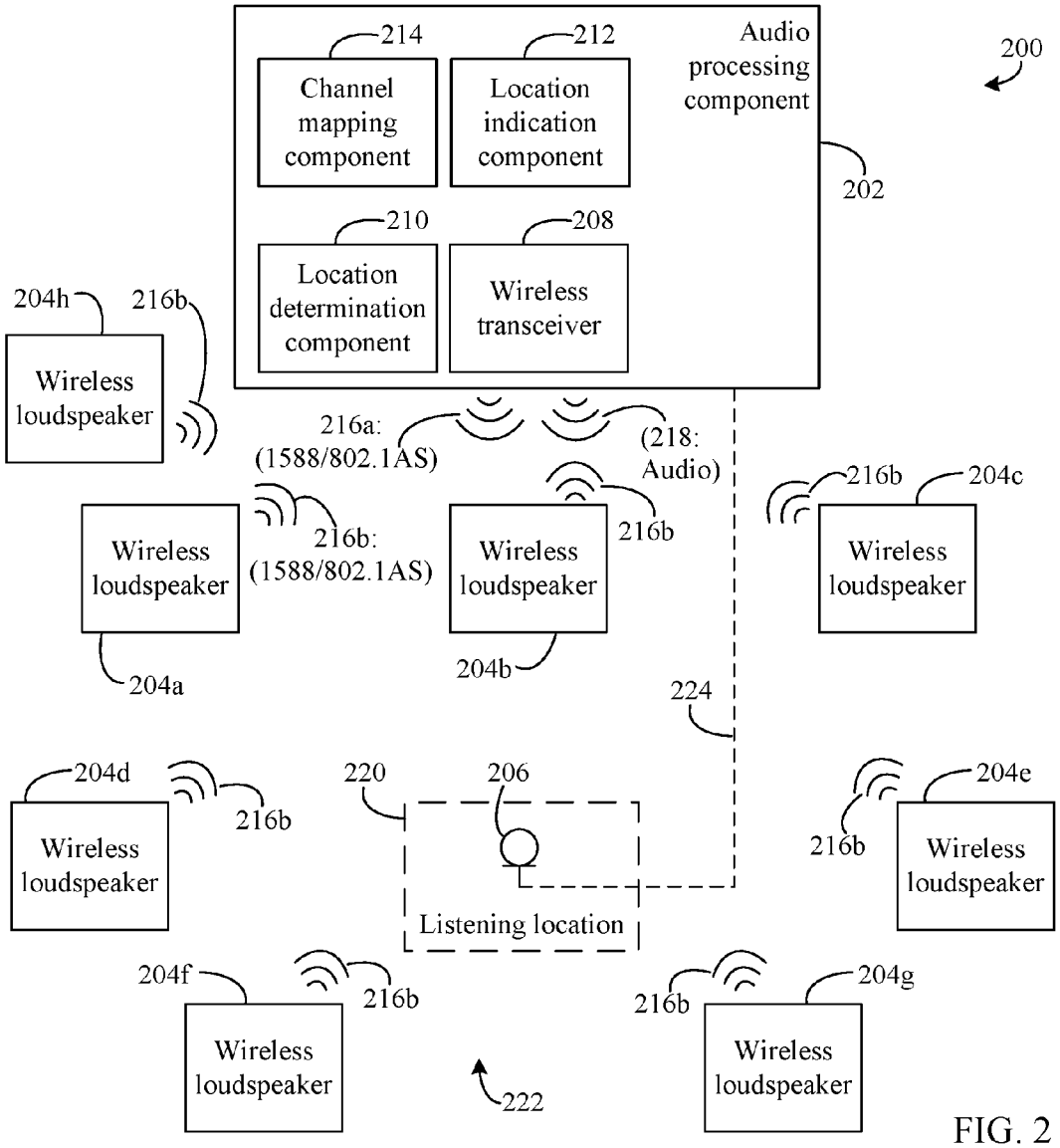
FIG. 2 shows a block diagram of a system with audio processing in an acoustic space, according to an example embodiment.

FIG. 2 shows a block diagram of a system 200 with audio processing, according to an embodiment. System 200 may be a further embodiment of system 100 of FIG. 1. System 200 includes an audio processing component 202, at least one microphone (microphone(s)) 206, and a plurality of wireless loudspeakers 204*a*-204*h*, in an acoustic space 222. Audio processing component 202 may be a further embodiment of audio processing component 102 of system 100 shown in FIG. 1. Audio processing component 202 includes a wireless transceiver 208, a location determination component 210, a location indication component 212, and a channel mapping component 214. Location determination component 210 may be a further embodiment of location determination component 104 of system 100 shown in FIG. 1.

As shown, plurality of wireless loudspeakers 204*a*-204*h* includes loudspeakers for specific audio channels such as Left (L) (204*a*), Right (R) (204*c*), Center (C) (204*b*), Surround Left (SL) (204*d*), Surround Right (SR) (204*e*), Rear Left (RL) (2040, Rear Right (RR) (204*g*), and Low-Frequency Effects (LFE) (204*h*). While exemplarily shown for illustration as including eight wireless loudspeakers in a 7.1 configuration (i.e., wireless loudspeakers 204*a*-204*h*), it is contemplated that system 200 may include any number of wireless loudspeakers in any other configuration as described herein. Wireless loudspeakers 204*a*-204*h* are configured to produce audio sounds based on audio information in wireless audio transmission signals.

Acoustic space 222 may be a further embodiment of acoustic space 114 of FIG. 1, and may be a room in a home, a theater, an office, or another 3-D space in which system 200 produces audio sounds via wireless loudspeakers 204*a*-204*h*, in embodiments, as described above. System 200 may perform active room correction for acoustic space 222, and it is contemplated herein that location determination component 210 may determine timing information as described herein from microphone signals based on sounds produced by wireless loudspeakers 204*a*-204*h* during the performance of active room correction.

Microphone(s) 206 may be wired or wireless and are configured to provide microphone signals corresponding to sounds generated by wireless loudspeakers 204*a*-204*h* to audio processing component 202 via a connection 224 from one or more positions/locations in acoustic space 222, e.g., positions in a listening location 220 which may comprise a single location or multiple locations in a 2-D or 3-D space. Microphone signals received by audio processing component 202, or information related thereto, may be provided to location determination component 210.

Wireless transceiver 208 is configured to send and/or receive wireless signals such as wireless audio transmission signals and wireless timing transmission signals. Wireless transceiver 208 may be a Wi-Fi® transceiver or other type of wireless communication device/component. Wireless transceiver 208 is configured to send and/or receive wireless signals to and/or from one or more positions/locations in acoustic space 222. Information transmitted by wireless transceiver 208 and information received by wireless transceiver 208 from wireless loudspeakers 204*a*-204*h* may be provided to location determination component 210.

Location determination component 210, location indication component 212 and channel mapping component 214 are discussed in further detail below.

A. Example Audio Signal Location Embodiments

Regardless of how accurate a loudspeaker can reproduce sounds in an anechoic chamber, the sound reflections off of walls, ceilings, and furnishings in a real room will inevitably color the sound and change the effective frequency response as perceived by a user or listener sitting in a primary listening position. This effect of room acoustics often results in degraded audio quality. To correct such room acoustics and improve the audio quality, audio devices for home theater systems may come with a microphone and a built-in loudspeaker setup/calibration procedure for the purpose of active room correction.

In this loudspeaker setup/calibration procedure, typically the audio device emits a sequence of white noise or sweep tones ("chirps") to each loudspeaker one at a time while recording the sound using the included microphone placed at one or more locations at or around the primary listening position (i.e., the "sweet spot"). By analyzing the recorded sounds in reference to the emitted sounds, the audio device can determine the gain, delay, and equalization (EQ) of the frequency response that needs to be applied to each loudspeaker to compensate for different loudspeaker distances to the listener and to correct the effects of the room acoustics so that a better listening experience can be obtained.

Similar loudspeaker setup/calibration is also necessary for wireless loudspeaker systems, especially for surround sound systems such as the popular 5.1 or 7.1 configurations. Because the audio system has both the emitted signal and the microphone-recorded signal available for each wireless loudspeaker, from the delay of the recorded signal relative to the emitted signal, the system can determine the loudspeaker distance to the microphone. Thus, a natural by-product of such wireless loudspeaker setup/calibration procedure is that by the time it is done, the system has 'N' sets of wireless loudspeaker distance measurements, where 'N' is the number of different microphone locations used during the calibration procedure.

Accordingly, if the user performs setup/calibration procedures and places the microphone around the primary listening position (e.g., at the ear level in the primary listening position, at the ear level to the left/right/front/back of the primary listening position, or two feet above the ear level in the primary listening position, etc.), then, if $N \geq 3$, the location of each loudspeaker on the horizontal 2D plane may be uniquely determined, and if $N \geq 4$, the loudspeaker locations in the 3-D space may be determined if at least one of the microphone positions is at a different height than the others. Similarly, the wireless transceiver can be placed at multiple locations to perform multiple sets of loudspeaker distance measurements and thus determine the loudspeaker locations. Such loudspeaker location information can be used either in audio channel mapping or to check for correct loudspeaker placement as described herein.

In terms of the number of different wireless transceiver positions or microphone positions needed (the number 'N') to achieve a certain kind of loudspeaker location determination (e.g., in 2D or 3D), the timing signal techniques herein and the audio signal loudspeaker-setup/calibration-based techniques are equivalent. However, the audio signal techniques do not require any additional user effort. This is because many loudspeaker-setup/calibration procedures require several microphone locations. For example, the Audyssey MultEQ XT loudspeaker setup/calibration procedure from Audyssey Laboratories, Inc. of Los Angeles, Calif., recommends up to eight microphone locations to optimize the listening experience of a larger "sweet spot" listening area (while the bare minimum for the number of microphone positions required for room correction is actually one, but in such a case the active room correction can only optimize for that single microphone location, resulting in a small "sweet spot" listening area) because with more microphone positions, the "sweet spot" listening area can be larger.

Because the loudspeaker-setup/calibration procedures require several different microphone locations, the user does not need to perform any extra step beyond these procedures for obtaining an automatic location determination by the described systems. At the end of the loudspeaker setup/calibration, a system according the embodiments herein already has enough location information to also automatically perform audio channel mapping and/or loudspeaker placement checking.

In embodiments, by way of illustrative example and not limitation, loudspeaker location determination may be performed using audio signals, such as wireless audio signals provided to wireless loudspeakers. For instance, wireless audio transmission signals are provided/transmitted to loudspeakers from a wireless transceiver of a system with an audio processing device/component. The loudspeakers produce sounds based on the received signals, and the sounds are received by one or more microphones which in turn provide corresponding microphone signals back to the audio processing device/component. The audio processing device/component determines a time delay from transmission of the wireless audio transmission signals to the reception of the microphone signals. This may be repeated for multiple microphone positions, and for each loudspeaker. The resulting timing delays are used to calculate telemetry for determining relative locations of the loudspeakers (e.g., with respect to the audio processing device/component or with respect to a listening location of a user). The determined locations may then be used to perform channel mapping of the loudspeakers by the audio processing device/component and/or to provide loudspeaker location indications indicative of correct or incorrect loudspeaker placements.

Figure 3:
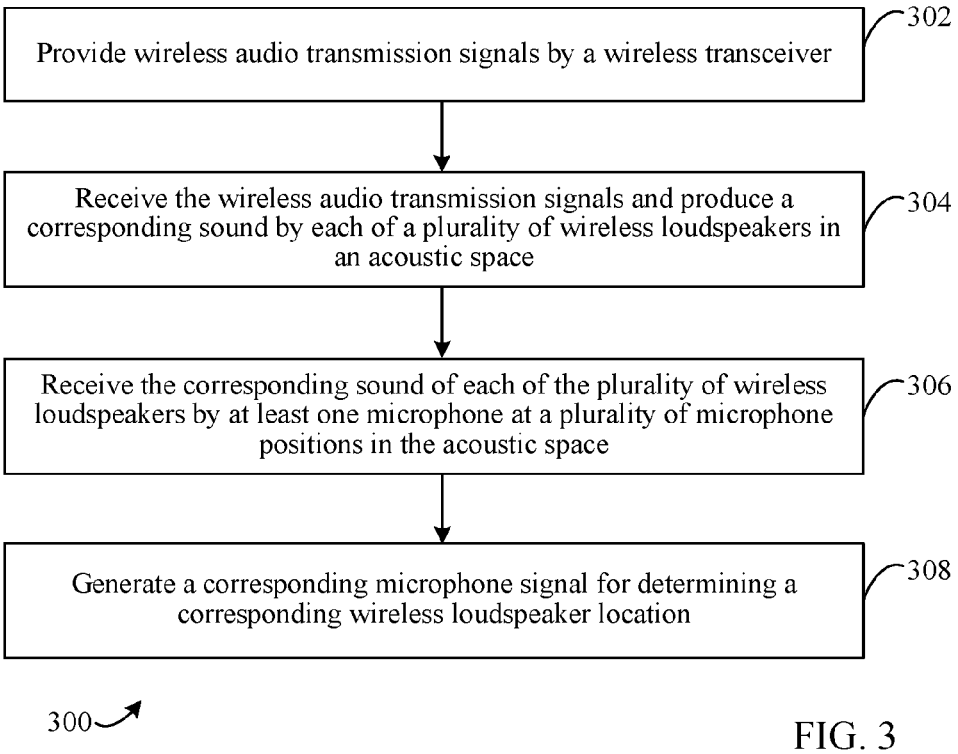
FIG. 3 shows a flowchart for generating signals for determining loudspeaker locations, according to an example embodiment.

Referring also to FIG. 3, a flowchart 300 for generating signals for determining loudspeaker locations by audio processing component 202 of FIG. 2 is shown, according to an embodiment. System 200, along with its subcomponents such as audio processing component 202, microphone(s) 206, and plurality of wireless loudspeakers 204*a*-204*h* are configured to perform their respective functions in accordance with flowchart 300, in embodiments. Flowchart 300 is described as follows.

Wireless audio transmission signals are provided by a wireless transceiver (302). For example, wireless transceiver 208 of audio processing component 202 is configured to provide/transmit wireless audio transmission signals 218 to plurality of wireless loudspeakers 204*a*-204*h* in acoustic space 222. Wireless audio transmission signals 218 include audio frames with audio information used by wireless loudspeakers 204*a*-204*h* to produce sounds. The audio information may be associated with any type of sound, such as but without limitation, sounds to be produced for active room correction.

The wireless audio transmission signals are received and a corresponding sound is produced by each of a plurality of wireless loudspeakers in an acoustic space (304). For instance, when wireless audio transmission signals 218 are provided in (302), wireless loudspeakers 204*a*-204*h* are configured to receive wireless audio transmission signals 218 and produce corresponding sounds. These sounds may be white noise, "chirps," tones, or other sounds according to the audio information of (302).

The corresponding sound of each of the plurality of wireless loudspeakers is received by at least one microphone at a plurality of microphone positions in the acoustic space (306). For example, microphone(s) 206 is configured to receive the corresponding sound of each of the plurality of wireless loudspeakers 204*a*-204*h* produced in (304).

As noted above, microphone(s) 206 is configured to receive these sounds at different positions in acoustic space 222, such as positions in listening location 220. In embodiments, the number of different positions may be 3, 4, or more, and the different positions include at least one position that is of a different relative height to the other positions in acoustic space 222.

Figure 4:
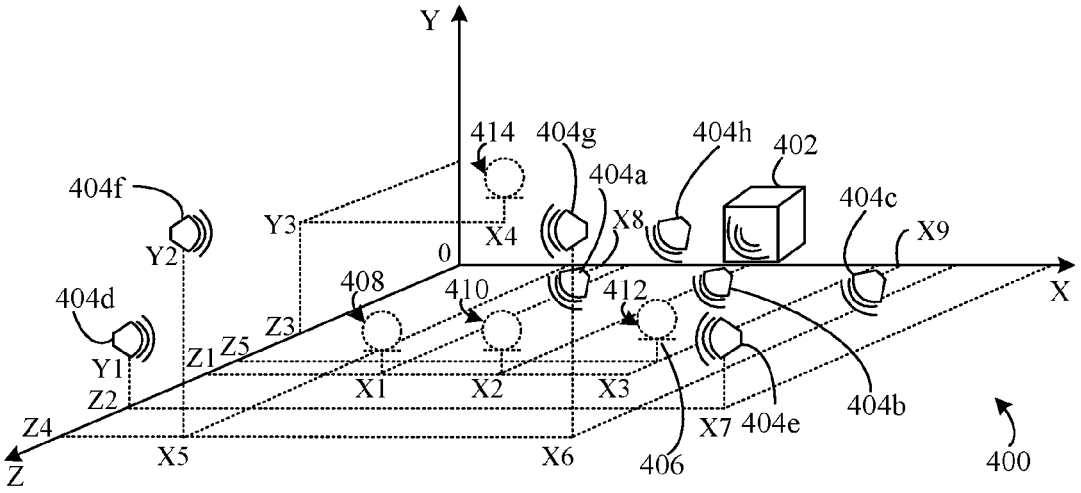
FIG. 4 shows a diagram of a system with audio processing and microphones positioned in an acoustic space, according to an example embodiment.

Turning now to FIG. 4, an example 3-D diagram of a system 400 with audio processing and a microphone(s) positioned in an acoustic space is shown, according to an embodiment. System 400 may be an embodiment of system 200 of FIG. 2, and is described with respect to FIGS. 2 and 3. For example, system 400 includes an audio processing component 402, wireless loudspeakers 404*a*-404*h*, and a microphone(s) 406, which may be further embodiments of audio processing component 202, wireless loudspeakers 204*a*-204*h*, and microphone(s) 206 of system 200 in FIG. 2, respectively. As shown in FIG. 4, microphone(s) 406 are located at an exemplary plurality of locations: a first position 408, a second position 410, a third position 412, and a fourth position 414. It should also be noted that in embodiments, another microphone location located at, or substantially at, audio processing component 402 may be used in place of any of these described microphone locations.

System 400 is located in an acoustic space (e.g., similar to or the same as acoustic space 222 of FIG. 2) denoted with 3-D coordinates specified by X-, Y-, and Z-axes having an origin point '0'.

As described above, in (306), a microphone(s) (e.g., microphone(s) 406 shown in FIG. 4) is configured to receive the corresponding sound of each of the plurality of wireless loudspeakers 404*a*-404*h* produced in (304). As shown in FIG. 4, loudspeaker 404*a* is located at (X8, Y0, Z0), loudspeaker 'R' 404*c* is located at (X9, Y0, Z0), loudspeaker 'C' 404*b* is located at (X2, Y0, Z0), loudspeaker 'SL' 404*d* is located at (X0, Y1, Z2), loudspeaker 'SR' 404*e* is located at (X7, Y1, Z2), loudspeaker 'RL' 404*f* is located at (X5, Y2, Z4), loudspeaker 'RR' 404*g* is located at (X6, Y2, Z4), and loudspeaker 'LFE' 404*h* is located at a point in an X-Y plane, e.g., at a point with a Z value less than or equal to 0.

As shown for illustrative purposes, $X0<X5<X8<X1<X2<X3<X9<X6<X7$, where X4 may have any relative value, e.g., an X value within the listening space of a user; $Y0<Y1<Y2$, and $Y3\neq Y0$; and $Z0<Z5<Z1<Z2<Z4$, where Z3 may have any relative value, e.g., a Z value within the listening space of a user. It should be noted that these locations may not be drawn to scale and are illustrative and non-limiting in natures. For instance, Z5 may be greater than Z1 in embodiments. In other embodiments, first position 408 and/or second position 410 may have a Z-value other than Z1 as long as at least one Z-value is different between first position 408, second position 410, and third position 412.

Other locations for a 7.1 loudspeaker configuration are also contemplated herein. Additionally, configurations for other loudspeaker embodiments, such as but without limitation, 2.0, 2.1, 5.1, beyond 7.1, etc., are contemplated herein for utilization in a similar manner as described with respect to FIGS. 3 and 4.

As shown in system 400, microphone(s) 406 is configured to receive sounds produced by wireless loudspeakers 404*a*-404*h* at the plurality of positions: first position 408 located at (X1, Y0, Z1), second position 410 located at (X2, Y0, Z1), third position 412 located at (X3, Y0, Z5), and fourth position 414 located at (X4, Y3, Z3).

Referring back to flowchart 300 of FIG. 3, a corresponding microphone signal is generated for determining a corresponding wireless loudspeaker location (308). Again referencing FIG. 4, for instance, microphone(s) 406 is configured to generate a corresponding microphone signal from the sounds received in (306). In a 2-D wireless loudspeaker configuration where wireless loudspeakers 404*a*-404*h* are in the same X-Z plane (not specifically illustrated), microphone(s) 406 receives sounds at first position 408, second position 410, and third position 412 from wireless loudspeakers 404*a*-404*h*. With sounds received from each of wireless loudspeakers 404*a*-404*h* at each of these three microphone location placements, microphone signals are generated by microphone(s) 406 corresponding to the received sounds at microphone locations 408, 410, and 412. The generated microphone signals are used to determine wireless loudspeaker 404*a*-404*h* locations, as described herein.

In a 3-D configuration, microphone(s) 406 also receives sounds at fourth position 414 for each of wireless loudspeakers 404*a*-404*h*, and microphone signals are generated by microphone(s) 406 corresponding to the received sounds at microphone locations 408, 410, 412, and 414.

In embodiments, a single microphone 406 may be placed at each of these positions at different times, while in other embodiments three or four microphones 406 may be simultaneous located at these locations where each of the microphones 406 respectively receive sounds from wireless loudspeakers 404*a*-404*h*.

B. Example IEEE 1588 and IEEE 802.1AS Location Embodiments

The IEEE 1588 and IEEE 802.1AS point-to-point protocol standards for precision time can be used to perform timing measurements, determine signal timing delays, which in turn can be used to determine distances between a wireless transceiver and each of the wireless loudspeakers in the system. Such a single distance measurement for each wireless loudspeaker is not sufficient to determine the location of the wireless loudspeakers because the wireless loudspeakers can be anywhere on the surface of a sphere that has the wireless transceiver at the center and the measured distance as the radius of the sphere.

If there is a second set of distance measurements with the wireless transceiver at a second location, then the intersection of the two spheres is a circle. With the wireless transceiver moved to a third location and repeating the distance measurements, the intersection of a circle and a sphere is two points in a 3D space such as an acoustic space. Repeating the measurements with the wireless transceiver at a fourth location, the ambiguity of the two possible points is thus resolved, and the precise location of each of the wireless loudspeakers can be determined.

If the relative heights of the wireless loudspeakers are not relevant (the relative locations of the wireless loudspeakers are in a 2D horizontal plane (which is sufficient for channel mapping of 2D wireless loudspeaker configurations)), then three different wireless transceiver locations are sufficient. However, one potential issue is that if the audio system does not know which three locations the user has placed the wireless transceiver relative to the primary listening position and the typical wireless loudspeaker placement, then the system still cannot determine which wireless loudspeaker should be assigned which audio channel. Thus, to make it useful for loudspeaker channel mapping, the audio system needs to know the wireless transceiver locations relative to the wireless loudspeakers.

This can be achieved if the initial system setup/calibration instructions clearly specify the locations the wireless transceiver should be placed relative to wireless loudspeakers. For example, a user can place the wireless transceiver first in the primary listening position to perform the first set of distance measurements. Then, the user places the wireless transceiver near the mid-point between the Left and Right wireless loudspeakers to perform the second set of distance measurements. Next, the user to places the wireless transceiver near a wireless loudspeaker, e.g., near the Right or Left wireless loudspeaker, to perform the third set of distance measurements. Because the system knows the locations of the wireless transceiver relative to the loudspeakers, it can be determined which wireless loudspeaker should be assigned which audio channel.

The system may also utilize the heights of the wireless loudspeakers in order to correct 2D surround sound wireless loudspeaker placements that are too high or too low, or if 3D wireless loudspeaker channel mapping is needed. In this case, a fourth set of distance measurements at a fourth wireless transceiver location is required. This fourth wireless transceiver location needs to be at a different height than the heights of the other three wireless transceiver locations. Again, a reference to the relative direction of height can be obtained by the user placing the wireless transceiver at a specific height, such as but not limited to, three feet above the last wireless transceiver location.

In embodiments, by way of illustrative example and not limitation, loudspeaker location determination may be performed using wireless timing information (e.g., IEEE 1588 and IEEE 802.1AS (Clause 12—802.11v) point-to-point protocol standards, or equivalents thereof). In embodiments, wireless timing information may be included in audio signals, such as wireless audio transmission signals provided to wireless loudspeakers as described herein, and in such embodiments, the wireless audio transmission signals may also be considered as wireless timing transmission signals. In other embodiments, separate wireless signals with wireless timing information may be used.

For instance, wireless signals (e.g., audio or otherwise as described herein) are provided/transmitted to loudspeakers from a wireless transceiver of a system with an audio processing device/component. The loudspeakers are configured to receive the wireless signals with wireless timing information, as described herein, and to provide corresponding responsive wireless signals that are received by the wireless transceiver of the audio processing device/component. The audio processing device/component determines a time delay from transmission of the wireless signals with wireless timing information from the wireless transceiver to the reception of responsive wireless signals by the wireless transceiver.

This may be repeated for multiple wireless transceiver positions, as well as for each loudspeaker, although it is contemplated herein that simultaneous or partially simultaneous performance of transmitting/receiving wireless timing information may be used. The resulting timing delays are used to calculate telemetry for determining relative locations of the loudspeakers (e.g., with respect to the audio processing device/component or with respect to a listening location of a user). The determined locations may then be used to perform channel mapping of the loudspeakers by the audio processing device/component and/or to provide loudspeaker location indications indicative of correct or incorrect loudspeaker placements.

Figure 5:
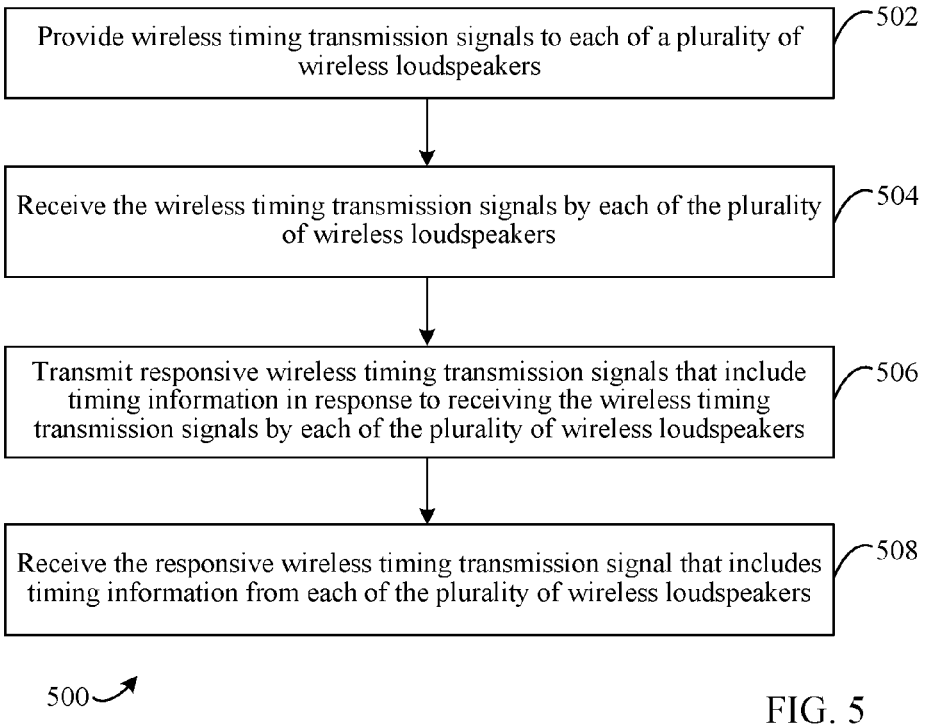
FIG. 5 shows a flowchart for generating signals for determining loudspeaker locations, according to an example embodiment.

Referring also to FIG. 5, a flowchart 500 for generating signals for determining loudspeaker locations by audio processing component 202 of FIG. 2 is shown, according to an embodiment. System 200, along with its subcomponents such as audio processing component 202, microphone(s) 206, and plurality of wireless loudspeakers 204*a*-204*h* are configured to perform their respective functions in accordance with flowchart 500, in embodiments. Flowchart 500 is described as follows.

Wireless timing transmission signals are provided to each of a plurality of wireless loudspeakers (502). For example, wireless transceiver 208 of audio processing component 202 is configured to provide/transmit wireless timing transmission signals 216*a* to plurality of wireless loudspeakers 204*a*-204*h* in acoustic space 222. Wireless timing transmission signals 216*a* include timing information used by audio processing component 202 to determine delays between signals being transmitted and received. The timing information may be associated with IEEE 1588 and IEEE 802.1AS (Clause 12—802.11v) point-to-point protocol standards, or equivalents thereof. In embodiments, wireless audio transmission signals 218 may include the timing information and be used in place of wireless timing transmission signals 216*a*. Wireless transceiver 208 is configured to provide/transmit wireless timing transmission signals 216*a* to plurality of wireless loudspeakers 204*a*-204*h* from a plurality of positions, as described in further detail below.

The wireless timing transmission signals are received by each of the plurality of wireless loudspeakers (504). For instance, when wireless timing transmission signals 216*a* are provided in (502), wireless loudspeakers 204*a*-204*h* are configured to receive wireless timing transmission signals 216*a*, e.g., via a loudspeaker wireless transceiver therein.

Responsive wireless timing transmission signals that include timing information are transmitted in response to receiving the wireless timing transmission signals by each of the plurality of wireless loudspeakers (506). For example, wireless loudspeakers 204*a*-204*h* are configured to transmit responsive wireless timing transmission signals 216*b*, e.g., via a loudspeaker wireless transceiver therein, after receiving wireless timing transmission signals 216*a*, as in (504).

The responsive wireless timing transmission signal that includes timing information is received from each of the plurality of wireless loudspeakers (508). As noted above, wireless transceiver 208 is configured to receive these responsive wireless signals that include timing information at different positions in acoustic space 222, such as positions in listening location 220. In embodiments, the number of different positions may be 3, 4, or more, and the different positions include at least one position that is of a different relative height to the other positions in acoustic space 222.

Figure 6:
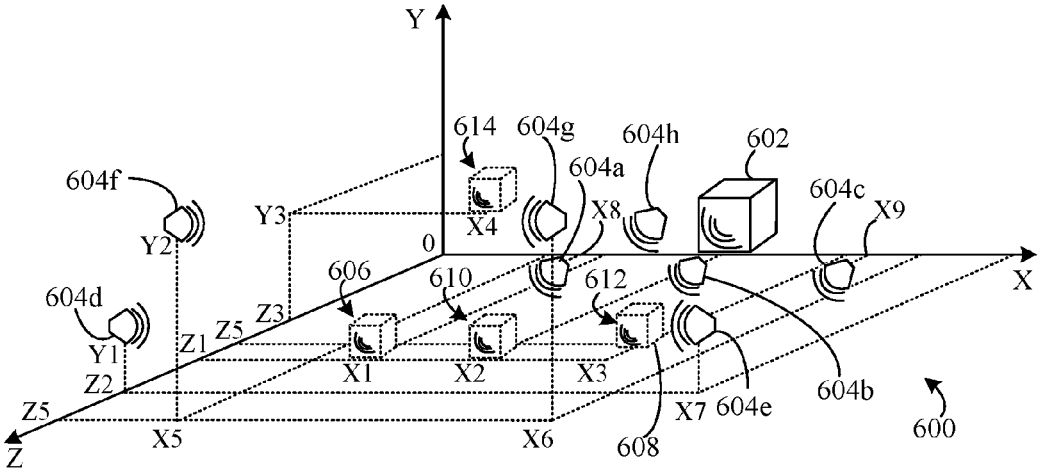
FIG. 6 shows a diagram of a system with audio processing and wireless transceivers positioned in an acoustic space, according to an example embodiment.

Turning now to FIG. 6, an example 3-D diagram of a system 600, with audio processing and a wireless transceiver, positioned in an acoustic space is shown, according to an embodiment. System 600 may be an embodiment of system 200 of FIG. 2, and is described with respect to FIGS. 2 and 5. For example, system 600 includes an audio processing component 602, wireless loudspeakers 604*a*-604*h*, and a wireless transceiver 608, which may be further embodiments of audio processing component 202, wireless loudspeakers 204*a*-204*h*, and wireless transceiver 206 of system 200 in FIG. 2, respectively. As shown in FIG. 6, wireless transceiver 608 may be located at an exemplary plurality of locations: a first position 606, a second position 610, a third position 612, and a fourth position 614. It should also be noted that in embodiments, another wireless transceiver location located at, or substantially at, audio processing component 602 may be used in place of any of these described microphone locations.

System 600 is located in an acoustic space (e.g., similar to or the same as acoustic space 222 of FIG. 2) denoted with 3-D coordinates specified by X-, Y-, and Z-axes having an origin point '0'.

As described above, each of the plurality of wireless loudspeakers 604*a*-604*h* is configured to receive a wireless timing transmission signals from wireless transceiver 608, e.g., in (504), and to transmit corresponding responsive wireless timing transmission signals back to wireless transceiver 608, e.g., in (506). As shown in FIG. 6, loudspeaker 1' 604*a* is located at (X8, Y0, Z0), loudspeaker 'R' 604*c* is located at (X9, Y0, Z0), loudspeaker 'C' 604*b* is located at (X2, Y0, Z0), loudspeaker 'SL' 604*d* is located at (X0, Y1, Z2), loudspeaker 'SR' 604*e* is located at (X7, Y1, Z2), loudspeaker 'RL' 604*f* is located at (X5, Y2, Z4), loudspeaker 'RR' 604*g* is located at (X6, Y2, Z4), and loudspeaker 'LFE' 604*h* is located at a point in an X-Y plane, e.g., at a point with a Z value less than or equal to 0.

As shown for illustrative purposes, $X0<X5<X8<X1<X2<X3<X9<X6<X7$, where X4 may have any relative value, e.g., an X value within the listening space of a user; $Y0<Y1<Y2$, and $Y3\neq Y0$; and $Z0<Z5<Z1<Z2<Z4$, where Z3 may have any relative value, e.g., a Z value within the listening space of a user. It should be noted that these locations may not be drawn to scale and are illustrative and non-limiting in natures. For instance, Z5 may be greater than Z1 in embodiments. In other embodiments, first position 606 and/or second position 610 may have a Z-value other than Z1 as long as at least one Z-value is different between first position 606, second position 610, and third position 612.

Other locations for a 7.1 loudspeaker configuration are also contemplated herein. Additionally, configurations for other loudspeaker embodiments, such as but without limitation, 2.0, 2.1, 5.1, beyond 7.1, etc., are contemplated herein for utilization in a similar manner as described with respect to FIGS. 5 and 6.

As shown in system 600, wireless transceiver 608 is configured to transmit wireless timing transmission signals to wireless loudspeakers 604*a*-604*h* and to receive corresponding responsive wireless timing transmission signals from wireless loudspeakers 604*a*-604*h* at the plurality of positions: first position 606 located at (X1, Y0, Z1), second position 610 located at (X2, Y0, Z1), third position 612 located at (X3, Y0, Z5), and fourth position 614 located at (X4, Y3, Z3).

For instance, also referencing FIG. 2, wireless transceiver 608 is configured to transmit wireless timing transmission signals (e.g., 216*a* as in FIG. 2) that include timing information to wireless loudspeakers 604*a*-604*h*, and to receive responsive wireless timing transmission signals (e.g., 216*b* as in FIG. 2) that include timing information from each of plurality of wireless loudspeakers 604*a*-604*h*. In a 2-D wireless loudspeaker configuration where wireless loudspeakers 604*a*-604*h* are in the same X-Z plane (not specifically illustrated), wireless transceiver 608 transmits wireless timing transmission signals and receives responsive wireless timing transmission signals at first position 606, second position 610, and third position 612 from wireless loudspeakers 604*a*-604*h*. With responsive wireless timing transmission signals including timing information received from each of wireless loudspeakers 604*a*-604*h* at each of these three wireless transceiver location placements, timing delays for full path or roundtrip signal flight for signals to and from each of wireless loudspeakers 604*a*-604*h* are generated by audio processing component 602. The timing delays are used to determine wireless loudspeaker 604*a*-604*h* locations, as described herein.

In a 3-D configuration, wireless transceiver 608 also transmits and receives wireless timing signals at fourth position 614 for each of wireless loudspeakers 604*a*-604*h*, and timing delays are generated by audio processing component 602 corresponding to the wireless transceiver locations 606, 610, 612, and 614.

In embodiments, a single wireless transceiver 608 may be placed at each of these positions at different times, while in other embodiments multiple wireless transceivers, e.g., three or four wireless transceivers 608, may be simultaneous located at these locations where each of these wireless transceivers 608 respectively transmit and receive wireless timing signal from wireless loudspeakers 604*a*-604*h*. It is also contemplated herein that wireless transceiver 608, or multiple instances thereof, may be integrated within audio processing component 602, may be detachable or physically separate, or may be separate devices with wireless transceivers such as smart phones and/or the like.

C. Example Audio Signal Location and IEEE 1588/IEEE 802.1AS Embodiments

In embodiments, a combination of audio signal location techniques, as in Subsection A above, and IEEE 1588/IEEE 802.1AS techniques, as in Subsection B above, may be utilized to determine wireless loudspeaker locations. It is possible to combine the two loudspeaker location determination methods above (based on IEEE 1588/IEEE 802.1AS and/or loudspeaker setup/calibration for room correction). That is, he resulting timing delays determined from audio signal location techniques and IEEE 1588/IEEE 802.1AS techniques are used to calculate telemetry for determining relative locations of the loudspeakers (e.g., with respect to the audio processing device/component or with respect to a listening location of a user). In an embodiment, a wireless transceiver location and two microphone locations may be utilized to determine wireless loudspeaker locations in a 2D plane. Such a technique provides a benefit to user in reducing the number of steps required to determine wireless loudspeaker locations and reducing the user's effort for wireless loudspeaker setup.

As an example, in a 5.1 surround sound wireless loudspeaker system with a wireless transceiver and a microphone(s), a user may first place the five satellite wireless loudspeakers and the subwoofer (i.e., an LTE loudspeaker) in their designated locations relative to a primary listening position of a user and an audio processing component, e.g., that may be operably coupled to a television (TV), as similarly described in FIGS. 4 and 6. The user then places the wireless transceiver of the audio processing component at a position between the Left and Right channel loudspeakers (e.g., this may be where the audio processing component is typically located, such as in a TV cabinet underneath the TV, or the like). It should be noted that the wireless transceiver does not have to be in the exact center between the Left and Right loudspeakers in embodiments. The wireless transceiver is then configured to transmit wireless timing transmission signals to and receive corresponding responsive wireless timing transmission signals from the wireless loudspeakers as described above with respect to FIGS. 5 and 6 to determine timing delays of the signals.

Next, the user places the microphone at an additional position such as at ear level in the primary listening position and then at another listening position (e.g., to the left or to the right of the primary listening position) to perform initial loudspeaker setup and calibration, e.g., for active room correction, as described herein with respect to FIGS. 3 and 4 above, where the microphone generates microphone signals corresponding to sounds produced by each of the wireless loudspeakers. It should be noted that at this point the wireless loudspeaker system may not yet have determined which wireless loudspeaker corresponds to which audio output channel, but this does not affect the described technique when there is a default channel mapping so each wireless loudspeaker is able to emit sounds in turn during the wireless loudspeaker setup/calibration procedure. After the microphone signals are generated, the wireless loudspeaker system has obtained three sets of loudspeaker distance measurement data (i.e., timing delays and two sets of generated microphone signals) from which the wireless loudspeaker system can uniquely determine the locations of each of the six wireless loudspeaker in the 5.1 configuration to one of the audio channels (L, C, R, SR, SL, and LFE) which in turn may be utilized to determine audio channel mapping as described herein.

It should be noted that the microphone signal generation may be performed prior to or approximately concurrently with the timing delay determination, or in any other order, according to embodiments. Additionally, more wireless transceiver positions may be utilized, and more or fewer microphone positions may be utilized in different embodiments.

The embodiments described in this subsection are efficient in the sense that the user typically places the audio processing component and wireless transceiver between the Left and Right wireless loudspeakers and uses at least one microphone position for the bare-minimum room correction. Accordingly, the only additional step the user has to perform to achieve the location determination and automatic channel mapping of wireless loudspeakers is to use a second microphone position. This is especially useful if a user only intends to use two microphone positions in the wireless loudspeaker calibration procedure for active room correction. That is, such a combination of the two loudspeaker distance measurement methods reduces the minimum number of microphone positions the user is required to use by 1, thus saving the user work and time, and being an increasingly robust solution.

If the user places the microphone (or the wireless transceiver in embodiments) in at least one more location with a different height than other locations, then the wireless loudspeaker system is also able to determine the relative heights of the wireless loudspeakers, e.g., in 3-D configurations, and either perform channel mapping for the height-mounted wireless loudspeakers, such as for Dolby® Atmos™, or check for correct wireless loudspeaker placement and recommend correction if necessary. For example, some wireless loudspeaker placement guidelines recommend placing the surround wireless loudspeakers higher than the ear level at a certain angle.

Alternatively, using both peer-to-peer and client-server distance/timing measurements, wireless loudspeakers which lie within or approximately within one horizontal plane may be positioned and then used to determine height once the location of one of the elevated speakers is determined by user interaction. Such techniques may be conducted using only the timing delay and distance measurements alone, e.g., via the wireless transceiver, according to embodiments. For example, once a fully interconnected 5.1 or 7.1 "ear-level" network topology has been used to establish channel mapping, distance measurements of all the ear-level wireless loudspeakers can be conducted with any individual elevated speaker.

In embodiments, if the user does not want to place the wireless transceiver between the Left and Right wireless loudspeakers, the user may place the satellite wireless loudspeakers according a figure showing a typical 5.1 configuration of L, C, R, SL, SR wireless loudspeakers and draw five straight lines from the primary listening position through each of the five satellite loudspeakers. These five lines divide the plane into five regions. Then during the initial system setup the wireless loudspeaker system is configured to prompt the user to identify in which region the user has placed the wireless transceiver. In terms of loudspeaker channel mapping, such information of the specific region out of the five regions the wireless transceiver is located is as good as the previously described timing information of the wireless transceiver being between the Left and Right loudspeakers.

D. Example Location Determination and Channel Mapping Embodiments

As noted herein, embodiments provide techniques for determining relative locations of wireless loudspeakers and performing channel mapping thereof. In this subsection, referring again to FIG. 2, location determination component 210, location indication component 212, and channel mapping component 214 are discussed in further detail.

Location determination component 210 is configured to determine locations of wireless loudspeakers 204*a*-204*h*, e.g., in acoustic space 222. Location determination component 210 is configured to receive and/or determine timing delay information associated with wireless timing transmission signals and with wireless audio transmission signals. For instance, telemetry information (e.g. angle, distance) for each of wireless loudspeakers 204*a*-204*h* may be determined by location determination component 210 based on the information associated with the wireless timing transmission signals and with the wireless audio transmission signals. Such telemetry information may be used by location determination component 210 to determine locations of wireless loudspeakers 204*a*-204*h*.

Figure 7:
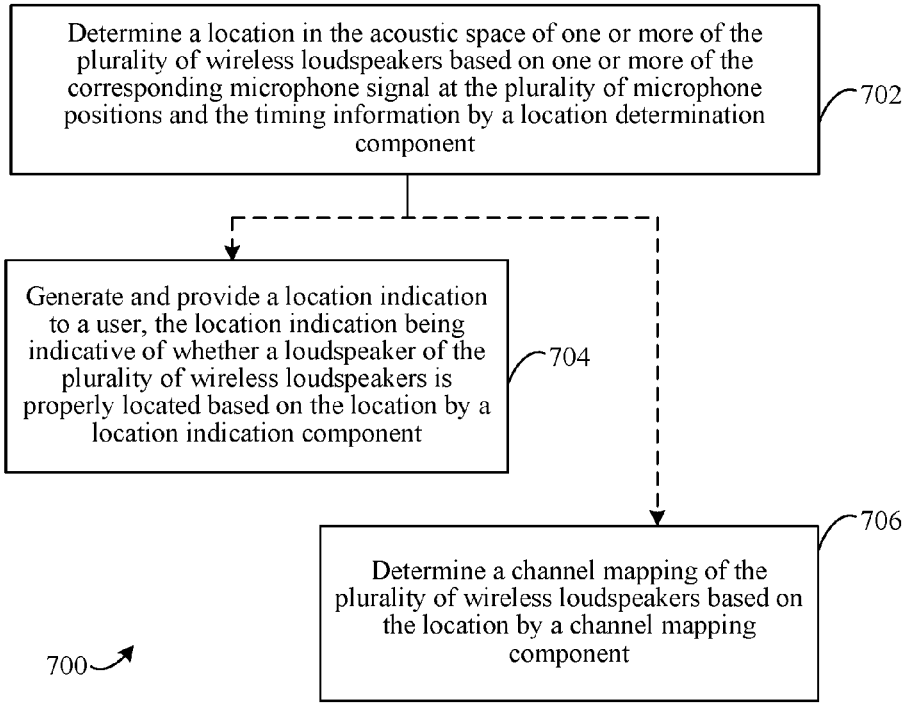
FIG. 7 shows a flowchart for determining loudspeaker locations, determining channel mapping, and providing loudspeaker location indications, according to an example embodiment.

Referring also to FIG. 7, a flowchart 700 for determining loudspeaker locations and audio channel mapping, according to an embodiment. System 200 of FIG. 2, along with its subcomponents such as audio processing component 202, location determination component 210, location indication component 212, and channel mapping component 214 are configured to perform their respective functions in accordance with flowchart 700, in embodiments. Flowchart 700 is described as follows.

A location in the acoustic space of one or more of the plurality of wireless loudspeakers is determined based on one or more of the corresponding microphone signal at the plurality of microphone positions and the timing information by a location determination component (702). In embodiments, location determination component 210 is configured to determine the location of wireless loudspeakers. For instance, audio processing component 202 is configured to determine a time delay between the transmission of wireless audio transmission signals 218 to plurality of wireless loudspeakers 204*a*-204*h*, and the reception of the microphone signals via connection 224 (e.g., as in flowchart 300 of FIG. 3). This may be repeated for multiple positions of microphone(s) 206/406, e.g., first position 408, second position 410, third position 412, fourth position 414, etc., as described above in FIG. 4, and for each wireless loudspeaker of wireless loudspeakers 404*a*-404*h*. These resulting delays are utilized to determine timing information that is used to calculate telemetry for determining relative locations of wireless loudspeakers 204*a*-204*h*/404*a*-404*h* (e.g., with respect to audio processing component 202/402 or with respect to listening location 220 of a user). Similarly, audio processing component 202 is configured to determine a time delay between the transmission of wireless timing transmission signals 216*a* to plurality of wireless loudspeakers 204*a*-204*h*, and the reception of the corresponding, responsive wireless timing transmission signals 216*b* (e.g., as in flowchart 500 of FIG. 5). This may be repeated for multiple microphone positions, e.g., first position 606, second position 610, third position 612, fourth position 614, etc., as described above in FIG. 6, and for each wireless loudspeaker of wireless loudspeakers 604*a*-604*h*. These resulting delays are utilized to determine timing information that is used to calculate telemetry for determining relative locations of wireless loudspeakers 204*a*-204*h*/604*a*-604*h* (e.g., with respect to audio processing component 202/602 or with respect to listening location 220 of a user). In embodiments, location determination component 210 is also configured to determine the described timing delays. Timing delays based on audio signals and/or on timing signals may be used to determine the wireless loudspeaker locations as described herein.

In some embodiments, location determination component 210 is configured to determine if the wireless loudspeaker locations are correct (e.g., according to manufacturer or other recommendations).

Continuing with flowchart 700, in embodiments, one or more of location indicating and channel mapping may be performed based on the location determination of wireless loudspeakers, as described herein.

Figure 8:
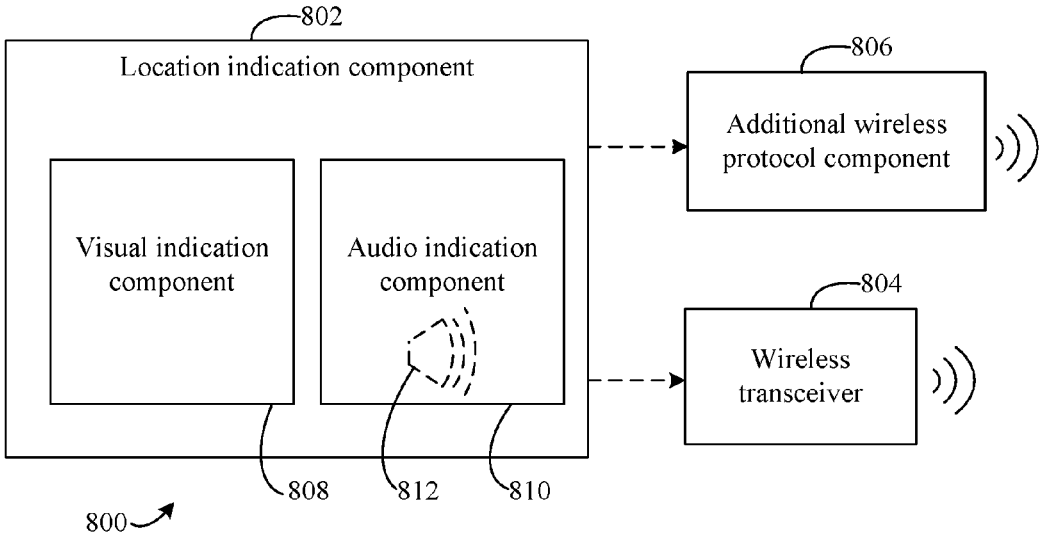
FIG. 8 shows a block diagram of a portion of a system with audio processing, according to an example embodiment.

A location indication is generated and provided to a user, the location indication being indicative of whether a loudspeaker of the plurality of wireless loudspeakers is properly located based on the location by a location indication component (704). For example, location indication component 210 of FIG. 2 is configured to generate and provide to a user a location indication that is indicative of whether a loudspeaker of a plurality of wireless loudspeakers is properly located, in embodiments. Turning now to FIG. 8, a block diagram of a portion of a system 800 with audio processing is shown, according to an embodiment. System 800 may be a further embodiment of system 200 of FIG. 2, system 400 of FIG. 4, and/or system 600 of FIG. 6. System 800 includes a location indication component 802 that may be a further embodiment of location indication component 212 of FIG. 2, a wireless transceiver 804 that may be a further embodiment of wireless transceiver 208 of FIG. 2 and/or wireless transceiver 608 of FIG. 6, and an additional wireless protocol component 806. Location indication component 802 includes a visual indication component 808 and an audio indication component 810.

Based on the determined location of wireless loudspeakers, e.g., such as wireless loudspeakers 204*a*-204*h*/404*a*-404*h*/604*a*-604*h* of FIGS. 2, 4, and 6, location indication component 802 is configured to determine of the wireless loudspeaker locations are correct or incorrect (e.g., according to manufacturer or other recommendations). In alternate embodiments, determinations of correct/incorrect wireless loudspeaker locations may be received from location determination component 210. Accordingly, indications of correct or incorrect wireless loudspeaker locations may be generated and provided to a user.

For instance, visual indication component 808 may be configured to provide a visual indication of correct or incorrect wireless loudspeaker locations via a display, touchscreen, light emitting diodes (LEDs), signals provided to a television from system 800 for display, and/or the like. Such indications may include a correct or incorrect status identifier, diagrams or wireless loudspeaker identifications, instructions to correct location errors, etc.

Audio indication component 810 may be configured to provide an audible indication of correct or incorrect wireless loudspeaker locations via a loudspeaker such as one of wireless loudspeakers 204*a*-204*h*/404*a*-404*h*/604*a*-604*h* of FIGS. 2, 4, and 6, via wireless transceiver 804 as similarly described elsewhere herein, or audio indication component 810 may comprise an additional loudspeaker 812 in system 800 to provide the audible indication. In embodiments, for an indication of an incorrect placement, the audible indication may be emitted by a wireless loudspeaker that incorrected located. Such indications may include a correct or incorrect status tones or speech audio, audible instructions to correct location errors, etc.

Additional wireless protocol component 806 may comprise a wireless transmitter/transceiver configured to provide wireless signals according to other protocols such as Bluetooth®, infrared, radio frequency, cellular modem protocols, etc., and may be used to provide any of the above location indications to a device of a user (e.g., a smartphone, a tablet computer, a laptop computer, etc.). In embodiments, wireless transceiver 804 may also, or alternatively, provide such location indications.

If an incorrect wireless loudspeaker location is determined, a user may change the location as prompted/indicated, and one or more of the automatic location determination techniques described herein may be repeated until placement of all wireless loudspeakers is correct according to the desired configuration.

Continuing with flowchart 700, a channel mapping of the plurality of wireless loudspeakers is determined based on the location by a channel mapping component (706). For instance, referring again to FIG. 2, channel mapping component 214 may be configured to determine channel mapping of wireless loudspeakers such as wireless loudspeakers 204*a*-204*h*, wireless loudspeakers 404*a*-404*h* of FIG. 4, or wireless loudspeakers 604*a*-604*h* of FIG. 6. In FIGS. 2, 4, and 6, example 7.1 configurations of wireless loudspeaker locations are shown. If loudspeakers are determined to be correctly placed as described above, channel mapping component 214 performs channel mapping for the different wireless loudspeaker channels (e.g., one or more of Left (L), Right (R), Center (C), Surround Left (SL), Surround Right (SR), Rear Left (RL), and Rear Right (RR), and Low-Frequency Effects (LFE), depending on the configuration. That is, because the wireless loudspeaker locations have been determined and are correct, the location of the wireless loudspeakers corresponds with the appropriate channel to be mapped by channel mapping component 214.

In embodiments, the channel mapping of the plurality of wireless loudspeakers is determined also based on corresponding microphone signals at the plurality of microphone positions, as described herein.

IV. Further Example Embodiments and Advantages

As noted above, systems and devices may be configured in various ways to perform methods for wireless loudspeaker location, position indication, and channel mapping according to the techniques and embodiments provided.

Audio signal location embodiments may utilize existing wireless loudspeaker setup/installation procedures of an audio processing component, such as but not limited to, active room correction to produce sounds for determining wireless loudspeaker locations, or in embodiments an audio processing component may be configured to produce sounds for location determination separately from existing procedures.

With regard to LFE wireless loudspeakers, there is not a single specific location that an LFE wireless loudspeaker (e.g., a subwoofer) must be placed in an acoustic space, but because the subwoofer is physically different from satellite loudspeakers and there is only one in the system, an LFE wireless loudspeaker may be pre-mapped its channel by the manufacturer. Accordingly, LFE wireless loudspeakers may not have to be part of the automatic channel mapping described above, in embodiments.

As noted herein, wireless loudspeakers may also include wireless transceivers configured to provide/transmit and receive additional wireless timing transmission signals with additional timing information to and from other wireless loudspeakers. By placing the wireless loudspeakers and audio processing device in operating modes such that in addition to the client-server network topology described in Section III, peer-to-peer networking is also supported (e.g., a true mesh interconnection versus a star topology), both the wireless loudspeakers and the audio processing device may also be configured to conduct timing measurements with their neighbors and build a network graph so as to use triangulation (as well as the trilateration methods previously described) to determine wireless loudspeaker locations. For example, one or more of wireless loudspeakers 204*a*-204*h* shown in FIG. 2 may include a transceiver configured to provide/transmit and receive additional wireless timing transmission signals according to IEEE 1588/IEEE 802.1AS protocols with additional timing information. Referring now to FIG. 6, it is contemplated that in embodiments wireless transceivers located in wireless loudspeakers 604*a*-604*h* and located in the described wireless loudspeakers positions may be used in addition to or lieu of one or more of wireless transceiver positions such as first position 606, second position 610, third position 612, and fourth position 614. That is, additional wireless transceivers located in wireless loudspeakers may be implemented in embodiments as described in Sections III, III. B., and III. C above.

Figure 9:
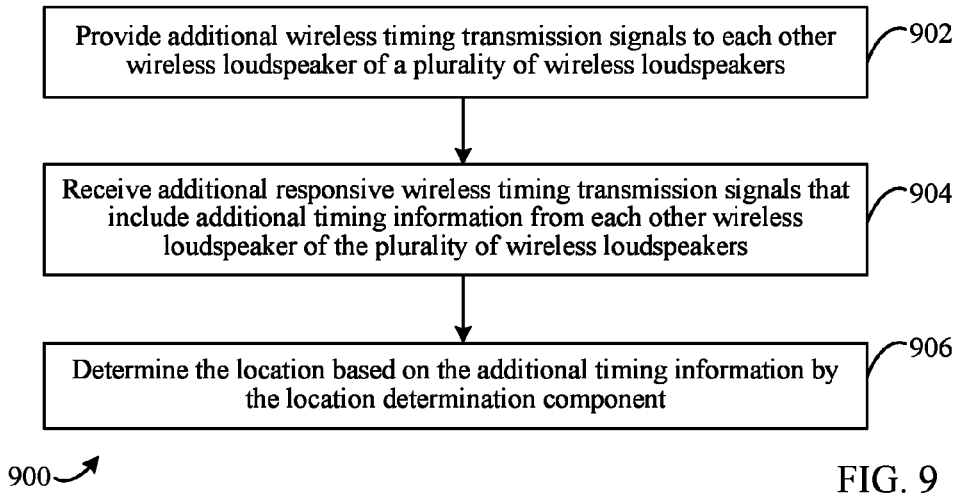
FIG. 9 shows a flowchart for determining loudspeaker locations, according to an example embodiment.

FIG. 9 shows a flowchart 900 for determining loudspeaker locations, according to an embodiment. System 200 of FIG. 2 and system 600 of FIG. 6, along with their respective subcomponents, are configured to perform their respective functions in accordance with flowchart 900, in embodiments. Flowchart 900 contemplates embodiments with wireless transceivers located in at least one wireless loudspeaker that are configured provide/transmit wireless timing transmission signals to other wireless loudspeakers. Flowchart 900 is described as follows.

Additional wireless timing transmission signals are provided to each other wireless loudspeaker of a plurality of wireless loudspeakers (902). For instance, one of wireless loudspeakers 204*a*-204*h* shown in FIG. 2 or one of wireless loudspeakers 604*a*-604*h* shown in FIG. 6 may provide additional wireless timing signals to each other of (or one or more of) wireless loudspeakers 204*a*-204*h* or wireless loudspeakers 604*a*-604*h*, respectively. That is, a wireless loudspeaker may provide wireless timing transmission signals with additional timing information similarly as described for wireless transceiver 208 of FIG. 1 and/or wireless transceiver 608 of FIG. 6 above.

Additional responsive wireless timing transmission signals that include additional timing information are received from each other wireless loudspeaker of the plurality of wireless loudspeakers (904). For example, one of wireless loudspeakers 204*a*-204*h* shown in FIG. 2 or one of wireless loudspeakers 604*a*-604*h* shown in FIG. 6 may receive additional responsive wireless timing signals to from each other of (or one or more of) wireless loudspeakers 204*a*-204*h* or wireless loudspeakers 604*a*-604*h*, respectively. That is, a wireless loudspeaker may receive responsive wireless timing transmission signals with additional timing information similarly as described for wireless transceiver 208 of FIG. 1 and/or wireless transceiver 608 of FIG. 6 above.

The location is determined based on the additional timing information by the location determination component (906). In flowchart 900, (906) may be a further embodiment of (702) of flowchart 700 in FIG. 7 where the determination of the location is also based on the additional timing information. In embodiments, the additional timing information received from each other wireless loudspeaker may be transmitted to an audio processing component by the wireless loudspeaker that initiated the additional wireless timing transmission signals in (902).

In embodiments, one or more of the operations of any flowchart described herein may not be performed. Moreover, operations in addition to or in lieu of any flowchart described herein may be performed. Further, in embodiments, one or more operations of any flowchart described herein may be performed out of order, in an alternate sequence, or partially (or completely) concurrently with each other or with other operations.

A "connector" or "connection," as used herein, may refer to a hardware connection or a wireless connection for the transfer of data, instructions, and/or information, according to embodiments The further example embodiments and advantages described in this Section may be applicable to embodiments disclosed in any other Section of this disclosure.

Embodiments and techniques, including methods, described herein may be performed in various ways such as, but not limited to, being implemented in hardware, or hardware combined with one or both of software and firmware.

V. Example Computer Implementations

System 100 of FIG. 1, system 200 of FIG. 2, system 400 of FIG. 4, system 600 of FIG. 6, and system 800 of FIG. 8, along with any respective components/subcomponents thereof, and/or any flowcharts, further systems, sub-systems, and/or components disclosed herein may be implemented in hardware (e.g., hardware logic/electrical circuitry), or any combination of hardware with one or both of software (computer program code or instructions configured to be executed in one or more processors or processing devices) and firmware. For example, embodiments may be implemented in systems and devices, as well as specifically customized hardware, ASICs, electrical circuitry, and/or the like.

Figure 10:
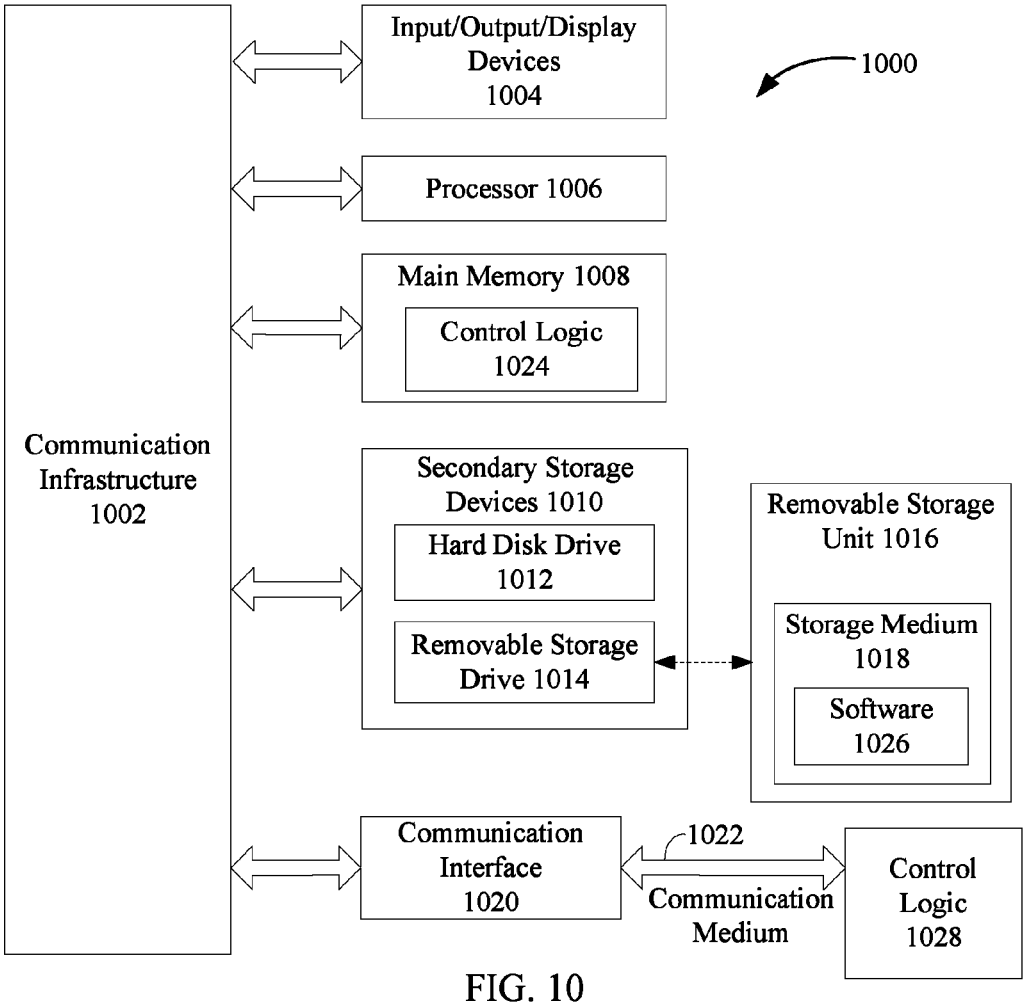
FIG. 10 shows a block diagram of a processing device/system in which the techniques disclosed herein may be performed and the example embodiments herein may be utilized.

The embodiments described herein, including circuitry, devices, systems, methods/processes, and/or apparatuses, may be implemented in or using well known processing devices, communication systems, servers, and/or, computers, such as a processing device 1000 shown in FIG. 10. It should be noted that processing device 1000 may represent audio processing devices/systems (e.g., system 100, system 200, system 400, system 600, and/or system 800), entertainment or multimedia systems/devices, processing devices, and/or traditional computers, including one or more portions thereof, in embodiments. For example, audio processing systems, components, and devices configured to perform location determination, and any of the sub-systems and/or components respectively contained therein and/or associated therewith, may be implemented in or using one or more processing devices 1000 and similar computing devices.

Processing device 1000 can be any commercially available and well known communication device, processing device, and/or computer capable of performing the functions described herein, such as devices/computers available from International Business Machines®, Apple®, Sun®, HP®, Dell®, Cray®, Samsung®, Nokia®, etc. Processing device 1000 may be any type of computer, including a desktop computer, a server, etc., and may be a computing device or system within another device or system.

Processing device 1000 includes one or more processors (also called central processing units, or CPUs), such as a processor 1006. Processor 1006 is connected to a communication infrastructure 1002, such as a communication bus. In some embodiments, processor 1006 can simultaneously operate multiple computing threads, and in some embodiments, processor 1006 may comprise one or more processors.

Processing device 1000 also includes a primary or main memory 1008, such as random access memory (RAM). Main memory 1008 has stored therein control logic 1024 (computer software), and data.

Processing device 1000 also includes one or more secondary storage devices 1010. Secondary storage devices 1010 include, for example, a hard disk drive 1012 and/or a removable storage device or drive 1014, as well as other types of storage devices, such as memory cards and memory sticks. For instance, processing device 1000 may include an industry standard interface, such a universal serial bus (USB) interface for interfacing with devices such as a memory stick. Removable storage drive 1014 represents a floppy disk drive, a magnetic tape drive, a compact disk drive, an optical storage device, tape backup, etc.

Removable storage drive 1014 interacts with a removable storage unit 1016. Removable storage unit 1016 includes a computer useable or readable storage medium 1018 having stored therein computer software 1026 (control logic) and/or data. Removable storage unit 1016 represents a floppy disk, magnetic tape, compact disk, DVD, optical storage disk, or any other computer data storage device. Removable storage drive 1014 reads from and/or writes to removable storage unit 1016 in a well-known manner.

Processing device 1000 also includes input/output/display devices 1004, such as touchscreens, LED and LCD displays, monitors, keyboards, pointing devices, etc.

Processing device 1000 further includes a communication or network interface 1020. Communication interface 1020 enables processing device 1000 to communicate with remote devices. For example, communication interface 1020 allows processing device 1000 to communicate over communication networks or mediums 1022 (representing a form of a computer useable or readable medium), such as LANs, WANs, the Internet, etc. Network interface 1020 may interface with remote sites or networks via wired or wireless connections.

Control logic 1028 may be transmitted to and from processing device 1000 via the communication medium 1022.

Any apparatus or manufacture comprising a computer useable or readable medium having control logic (software) stored therein is referred to herein as a computer program product or program storage device. This includes, but is not limited to, processing device 1000, main memory 1008, secondary storage devices 1010, and removable storage unit 1016. Such computer program products, having control logic stored therein that, when executed by one or more data processing devices, cause such data processing devices to operate as described herein, represent embodiments.

Techniques, including methods, and embodiments described herein may be implemented by hardware (digital and/or analog) or a combination of hardware with one or both of software and/or firmware. Techniques described herein may be implemented by one or more components. Embodiments may comprise computer program products comprising logic (e.g., in the form of program code or software as well as firmware) stored on any computer useable medium, which may be integrated in or separate from other components. Such program code, when executed by one or more processor circuits, causes a device to operate as described herein. Devices in which embodiments may be implemented may include storage, such as storage drives, memory devices, and further types of physical hardware computer-readable storage media. Examples of such computer-readable storage media include, a hard disk, a removable magnetic disk, a removable optical disk, flash memory cards, digital video disks, random access memories (RAMs), read only memories (ROM), and other types of physical hardware storage media. In greater detail, examples of such computer-readable storage media include, but are not limited to, a hard disk associated with a hard disk drive, a removable magnetic disk, a removable optical disk (e.g., CDROMs, DVDs, etc.), zip disks, tapes, magnetic storage devices, MEMS (micro-electromechanical systems) storage, nanotechnology-based storage devices, flash memory cards, digital video discs, RAM devices, ROM devices, and further types of physical hardware storage media. Such computer-readable storage media may, for example, store computer program logic, e.g., program modules, comprising computer executable instructions that, when executed by one or more processor circuits, provide and/or maintain one or more aspects of functionality described herein with reference to the figures, as well as any and all components, capabilities, and functions therein and/or further embodiments described herein.

Such computer-readable storage media are distinguished from and non-overlapping with communication media (do not include communication media). Communication media embodies computer-readable instructions, data structures, program modules or other data in a modulated data signal such as a carrier wave. The term "modulated data signal" means a signal that has one or more of its characteristics set or changed in such a manner as to encode information in the signal. By way of example, and not limitation, communication media includes wireless media such as acoustic, radio frequency (RF), infrared and other wireless media, as well as wired media and signals transmitted over wired media. Embodiments are also directed to such communication media.

The techniques and embodiments described herein may be implemented as, or in, various types of devices. For instance, embodiments may be included, without limitation, in processing devices (e.g., illustrated in FIG. 10) such as computers and servers, as well as communication systems such as switches, routers, gateways, and/or the like, communication devices such as smart phones, home electronics, gaming consoles, entertainment devices/systems, etc. A device, as defined herein, is a machine or manufacture as defined by 35 U.S.C. § 101. That is, as used herein, the term "device" refers to a machine or other tangible, manufactured object and excludes software and signals. Devices may include digital circuits, analog circuits, or a combination thereof. Devices may include one or more processor circuits (e.g., central processing units (CPUs), processor 1006 of FIG. 10), microprocessors, digital signal processors (DSPs), and further types of physical hardware processor circuits) and/or may be implemented with any semiconductor technology in a semiconductor material, including one or more of a Bipolar Junction Transistor (BJT), a heterojunction bipolar transistor (HBT), a metal oxide field effect transistor (MOSFET) device, a metal semiconductor field effect transistor (MESFET) or other transconductor or transistor technology device. Such devices may use the same or alternative configurations other than the configuration illustrated in embodiments presented herein.

VI. Conclusion

While various embodiments have been described above, it should be understood that they have been presented by way of example only, and not limitation. It will be apparent to persons skilled in the relevant art that various changes in form and detail can be made therein without departing from the spirit and scope of the embodiments. Thus, the breadth and scope of the embodiments should not be limited by any of the above-described exemplary embodiments, but should be defined only in accordance with the following claims and their equivalents.

What is claimed is:

1. A system comprising:

a plurality of wireless loudspeakers for an acoustic space, each configured to:

receive wireless audio transmission signals and produce a corresponding sound;

receive wireless timing transmission signals; and transmit responsive wireless timing transmission signals in response to receiving the wireless timing transmission signals; and an audio processing component comprising:

a wireless transceiver configured to:

provide the wireless audio transmission signals;

provide the wireless timing transmission signals to each of the plurality of wireless loudspeakers; and receive the responsive wireless timing transmission signal that includes timing information from each of the plurality of wireless loudspeakers;

at least one microphone configured to:

receive the corresponding sound of each of the plurality of wireless loudspeakers at a plurality of microphone positions in the acoustic space; and generate a corresponding microphone signal for each of the plurality of microphone positions for determining a corresponding wireless loudspeaker location;

a location determination component configured to:

determine a location in the acoustic space of one or more of the plurality of wireless loudspeakers based on one or more of the corresponding microphone signals at the plurality of microphone positions and the timing information; and at least one of:

a channel mapping component configured to determine a channel mapping of the plurality of wireless loudspeakers based on the location; or a location indication component configured to generate and provide a location indication, the location indication being indicative of whether a loudspeaker of the plurality of wireless loudspeakers is properly located based on the location.

2. The system of claim 1, wherein the at least one microphone and the channel mapping component are configured to setup or calibrate the plurality of wireless loudspeakers, at least in part, according to an active room correction scheme.

3. The system of claim 1, wherein the wireless transceiver is configured to:

provide the wireless timing transmission signals to each of the plurality of wireless loudspeakers and receive the responsive wireless timing transmission signal that includes timing information from each of the plurality of wireless loudspeakers at a plurality of positions in the acoustic space.

4. The system of claim 3, wherein the wireless transceiver is configured to receive the responsive wireless timing transmission signals according to a 2-D loudspeaker configuration or according to a 3-D loudspeaker configuration.

5. The system of claim 1, wherein the wireless transceiver is configured to transmit wireless timing transmission signals according to the IEEE 1588 and IEEE 802.1AS point-to-point protocol standards.

6. The system of claim 1, wherein the location indication comprises at least one of an audio indication or a visual indication; or wherein the location indication comprises at least one of an audio indication or a visual indication that provides corrective location information for a wireless loudspeaker of the plurality of wireless loudspeakers.

7. The system of claim 1, wherein an additional wireless transceiver is included in one or more of the plurality of wireless loudspeakers, and is configured to:

provide additional wireless timing transmission signals to each other wireless loudspeaker of the plurality of wireless loudspeakers; and receive additional responsive wireless timing transmission signals that include additional timing information from each other wireless loudspeaker of the plurality of wireless loudspeakers; and wherein the location determination component is configured to determine the location based on the additional timing information.

8. The system of claim 1, wherein a location of a loudspeaker of the plurality of loudspeakers is determined according to at least one corresponding microphone signal and at least one instance of location information.

9. A system comprising:

a wireless transceiver configured to:

provide wireless timing transmission signals to each of a plurality of wireless loudspeakers for an acoustic space; and receive a responsive wireless timing transmission signal that includes timing information from each of the plurality of wireless loudspeakers;

a location determination component configured to:

determine a location in the acoustic space of one or more of the plurality of wireless loudspeakers based on the timing information; and at least one of:

a channel mapping component configured to determine a channel mapping of the plurality of wireless loudspeakers based on the location; or a location indication component configured to generate and provide a location indication, the location indication being indicative of whether a loudspeaker of the plurality of wireless loudspeakers is properly located based on the location.

10. The system of claim 9, wherein the wireless transceiver is configured to:

provide the wireless timing transmission signals to each of the plurality of wireless loudspeakers in the acoustic space, and receive the responsive wireless timing transmission signal from each of the plurality of wireless loudspeakers, at a plurality of positions in the acoustic space.

11. The system of claim 9, wherein the location indication comprises at least one of an audio indication or a visual indication, or wherein the location indication comprises at least one of an audio indication or a visual indication that provides corrective location information for a wireless loudspeaker of the plurality of wireless loudspeakers.

12. The system of claim 9, wherein the location determination component is configured to determine the location according to a 2-D loudspeaker configuration or according to a 3-D loudspeaker configuration.

13. The system of claim 9, wherein the wireless transceiver is configured to transmit and receive wireless location transmission signals according to the IEEE 1588 and IEEE 802.1AS point-to-point protocol standards.

14. The system of claim 9, wherein an additional wireless transceiver is included in one or more of the plurality of wireless loudspeakers, and is configured to:

provide additional wireless timing transmission signals to each other wireless loudspeaker of the plurality of wireless loudspeakers and to the wireless transceiver; and receive additional responsive wireless timing transmission signals that include additional timing information from each other wireless loudspeaker of the plurality of wireless loudspeakers and from the wireless transceiver.

15. The system of claim 14, wherein the location determination component is configured to determine the location based on the additional timing information.

16. A method comprising:

providing wireless timing transmission signals to each of a plurality of wireless loudspeakers for an acoustic space; and receiving a responsive wireless timing transmission signal that includes timing information from each of the plurality of wireless loudspeakers;

determining a location in the acoustic space of one or more of the plurality of wireless loudspeakers based on the timing information; and at least one of:

determining a channel mapping of the plurality of wireless loudspeakers based on the location; or generating and providing a location indication, the location indication being indicative of whether a loudspeaker of the plurality of wireless loudspeakers is properly located based on the location.

17. The method of claim 16, wherein the location indication comprises at least one of an audio indication or a visual indication.

18. The method of claim 16, wherein the location indication comprises at least one of an audio indication or a visual indication that provides corrective location information for a wireless loudspeaker of the plurality of wireless loudspeakers.

19. The method of claim 16, wherein determining the location includes determining the location according to a 2-D loudspeaker configuration or according to a 3-D loudspeaker configuration.

20. The method of claim 16, wherein the wireless timing transmission signals are configured according to the IEEE 1588 and IEEE 802.1AS point-to-point protocol standards.

* * * * *